US006532738B2

(12) United States Patent
Sharkness et al.

(10) Patent No.: US 6,532,738 B2
(45) Date of Patent: Mar. 18, 2003

(54) SYSTEM FOR REDUCING BOOM SWING OSCILLATION IN A BACKHOE ASSEMBLY

(75) Inventors: Eric Sharkness, Troy, MI (US); Dennis Heyne, Burlington, IA (US); Richard J. Lech, Burlington, IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/962,893

(22) Filed: Sep. 25, 2001

(65) Prior Publication Data

US 2002/0038548 A1 Apr. 4, 2002

Related U.S. Application Data

(63) Continuation-in-part of application No. 09/661,348, filed on Sep. 14, 2000.

(51) Int. Cl.[7] ..... F16B 31/02
(52) U.S. Cl. ..... 60/468
(58) Field of Search ..... 60/468, 469, 494, 60/454, 329

(56) References Cited

U.S. PATENT DOCUMENTS

| | | | | | |
|---|---|---|---|---|---|
| 4,586,332 | A | * | 5/1986 | Schexnayder | 60/468 |
| 4,628,690 | A | * | 12/1986 | Arai et al. | 60/464 |
| 4,694,649 | A | * | 9/1987 | Howeth | 137/505.13 |
| 5,025,626 | A | * | 6/1991 | Crosser et al. | 60/460 |
| 5,048,296 | A | * | 9/1991 | Sunamura et al. | 60/468 |
| 5,419,132 | A | * | 5/1995 | Sato et al. | 60/468 |
| 5,709,083 | A | * | 1/1998 | Sorbel et al. | 60/394 |

* cited by examiner

*Primary Examiner*—Edward K. Look
*Assistant Examiner*—Igor Kershteyn
(74) *Attorney, Agent, or Firm*—A. N. Trausch

(57) ABSTRACT

A system for damping incipient oscillation in a linkage such as a backhoe assembly includes a crossover valve that connects the two supply lines that provide hydraulic fluid to a linkage actuator such as a boom swing hydraulic cylinder. The crossover valve is configured to open in response to the deceleration of the backhoe assembly.

41 Claims, 5 Drawing Sheets

SYSTEM FOR REDUCING BOOM SWING OSCILLATION IN A BACKHOE ASSEMBLY

CROSS-REFERENCES TO RELATED APPLICATIONS, IF ANY

This application is a continuation-in-part of U.S. Ser. No. 09/661,348 filed on Sep. 14, 2000 and entitled "Hydraulic System And Method For Regulating Pressure Equalization To Suppress Oscillation In Heavy Equipment".

FIELD OF THE INVENTION

In general, the invention relates to hydraulic systems used in the operation of heavy equipment. More specifically, the invention relates to a electrohydraulic or hydraulic system used for regulating pressure equalization to alleviate harsh oscillation common in the operation of heavy equipment, including but not limited to backhoes, excavators, skid steer drives, crawler drives, outriggers, and wheel loaders.

BACKGROUND OF THE INVENTION

In general, construction and other heavy equipment use hydraulic systems to perform digging, loading, craning, and like operations. The speed and direction of these functions are controlled with hydraulic valves. Typically at the end of a moving function, the assembly exhibits uncontrolled changes in speed and direction producing an oscillatory motion. For example, in a backhoe, the oscillatory motion occurs when its linkage is brought to a stop following a side-to-side maneuver. This oscillation makes it more difficult for the backhoe operator to return the bucket to a given position. The oscillation is caused when the kinetic energy generated by the backhoe movement is transferred to the hydraulic supply lines connected to the backhoes actuators when stopping. The transferred energy produces a sharp increase (or spike) in fluid pressure in the stopping actuator. The increased fluid pressure transfers the energy into the hydraulic system and the surrounding vehicle. The energy then returns in the opposite direction through the hydraulic lines and exerts the force into the original driving actuator. This transfer of energy continues until it is dispelled as heat, or is dissipated through the oscillation of the equipment and the swelling of the hydraulic lines.

Thus, there is a need in the hydraulic system for an additional system that reduces the amount of oscillatory motion that occurs when a swinging backhoe or other heavy machinery component is brought to a stop. Further, there is a need for increasing the accuracy when swinging the backhoe or other heavy machinery linkage to a desired location.

SUMMARY OF THE INVENTION

In accordance with a first embodiment of the invention, a hydraulic system for suppressing oscillation in a linkage of heavy equipment is provided that includes first and second hydraulic conduits, a crossover valve in communication with the first and second hydraulic conduits to control the flow of hydraulic fluid between the first and second conduits, and a hydraulic control circuit in communication with the valve and configured to open the valve in response to the deceleration of the heavy equipment. The system may include at least one dual-ported hydraulic cylinder coupled to the linkage to move the linkage and further wherein the hydraulic control circuit is responsive to a flow of fluid ejected from the cylinder by conversion of kinetic energy of the linkage. The valve may be configured to open in response to the flow of fluid ejected from the cylinder by conversion of kinetic energy of the linkage. The valve, once opened, may be configured to remain open for a predetermined period of time after stoppage of the flow of fluid ejected from the cylinder by conversion of kinetic energy of the linkage. The hydraulic control circuit may include a first hydraulic signal line coupled to the valve to apply a closing force to the valve and a second hydraulic signal line coupled to the valve to apply an opening force to the valve. The fluid pressure applied to the first signal line may tend to close the valve and fluid pressure applied to the second hydraulic signal line may tend to open the valve. The first hydraulic signal line may be fluidly coupled to the first conduit when the fluid pressure in the first conduit is greater than the fluid pressure in the second conduit and may be also fluidly coupled to the second conduit when the fluid pressure in the second conduit is greater than the fluid pressure in the first conduit. The second hydraulic signal line may be fluidly coupled to the first conduit when the fluid pressure in first conduit is greater than the fluid pressure in the second conduit and may be also fluidly coupled to the second conduit when the fluid pressure in second conduit is greater than the fluid pressure in the first conduit. The first hydraulic signal line may be configured to prevent hydraulic fluid that has entered the first hydraulic signal line from returning to the first and second conduits. The first hydraulic signal line may include at least one check valve configured to prevent fluid in the first hydraulic line from returning to the first and second conduits. The valve may be configured (1) to open in response to a flow of fluid in the first conduit that is ejected from the cylinder by conversion of kinetic energy of the linkage, and (2) to open in response to a flow of fluid in the second conduit that is ejected from the cylinder by conversion of kinetic energy of the linkage. The system may include a first flow restriction device fluidly coupled to the first conduit between a first and a second portion of the first conduit to provide a first pressure drop in response to fluid flow in a first direction through the first conduit. The hydraulic control circuit may include a first hydraulic signal line fluidly coupled to and between the valve and the first portion of the first conduit and configured to apply a closing force to the valve, and a second hydraulic signal line fluidly coupled to and between the valve and the second portion of the first conduit and configured to apply an opening force to the valve. Fluid pressure applied to the first signal line may tend to close the valve and fluid pressure applied to the second hydraulic signal line may tend to open the valve. The system may include a second flow restriction device fluidly coupled to the second conduit between a first and a second portion of the second conduit to provide a second pressure drop in response to fluid flow in a first direction through the second conduit. The system may include a third flow restriction device fluidly coupled to the first conduit between the first and the second portion of the first conduit to provide a second pressure drop in response to fluid flow through the first conduit in a second direction opposite the first direction. The first pressure drop and the second pressure drop may be different. The first pressure drop may be less that the second pressure drop. The valve may be configured (1) not to open when a pressure difference equal to the first pressure drop is applied across the valve; and (2) to open when a pressure difference equal to the second pressure drop is applied across the valve.

In accordance with a second embodiment of the invention, a backhoe is provided that includes a vehicle, a hydraulic fluid pump, a hydraulic fluid tank fluidly coupled to and providing hydraulic fluid to the pump, a backhoe assembly coupled to the vehicle to swing with respect to the vehicle, at least one bi-directional dual-ported boom swing cylinder coupled to the backhoe assembly and the vehicle to swing the assembly, a bi-directional hydraulic control valve fluidly coupled to the pump and to the tank and to the at least one cylinder to regulate the flow rate and direction of the flow of actuating fluid to the at least one cylinder, first and second hydraulic conduits coupled to and between the control valve and the at least one cylinder, wherein the first and second hydraulic conduits are disposed to conduct the flow of hydraulic fluid to the at least one cylinder from the control valve and to the control valve from the at least one cylinder, and a swing damping circuit coupled to the first and second conduits for suppressing oscillation of the backhoe assembly, the circuit comprising a crossover valve in fluid communication with the first and second conduits to control the flow of hydraulic fluid between the first and second conduits and a hydraulic control circuit in communication with the crossover valve and configured to open the crossover valve in response to deceleration of the backhoe assembly with respect to the vehicle. The backhoe of claim 20, wherein the hydraulic control circuit may be responsive to a flow of fluid ejected from the cylinder by conversion of kinetic energy of the backhoe assembly. The crossover valve may be configured to open in response to the flow of fluid ejected from the cylinder by conversion of kinetic energy of the backhoe assembly. The hydraulic control circuit may include a first hydraulic signal line coupled to the crossover valve to apply a closing force to the crossover valve, and a second hydraulic signal line coupled to the crossover valve to apply an opening force to the crossover valve. Fluid pressure applied to the first hydraulic signal line may tend to close the crossover valve and fluid pressure applied to the second hydraulic signal line may tend to open the crossover valve. The first hydraulic signal line may be fluidly coupled to the first conduit when the fluid pressure in the first conduit is greater than the fluid pressure in the second conduit, and wherein the first hydraulic signal line may be also fluidly coupled to the second conduit when the fluid pressure in the second conduit is greater than the fluid pressure in the first conduit. The second hydraulic signal line may be fluidly coupled to the first conduit when the fluid pressure in the first conduit is greater than the fluid pressure in the second conduit and wherein the second hydraulic signal line may be also fluidly coupled to the second conduit when the fluid pressure in the second conduit is greater than the fluid pressure in the first conduit. The first hydraulic signal line may be configured to prevent hydraulic fluid that has entered the first hydraulic signal line from returning to the first and second conduits. The first hydraulic signal line may include at least one check valve configured to prevent fluid from the first hydraulic signal line from returning to the first and second conduits. The crossover valve may be configured (1) to open in response to a flow of fluid in the first conduit that is ejected from the cylinder by conversion of kinetic energy of the backhoe assembly, and (2) to open in response to a flow of fluid in the second conduit that is ejected from the cylinder by conversion of kinetic energy of the backhoe assembly. The hydraulic control circuit may be configured to apply the fluid ejected from the cylinder to the crossover valve to open the crossover valve to a position in which fluid can flow between the first and second conduits. The control valve may be configured to cause the deceleration of the backhoe assembly. The cylinder may include an internal piston that is movable inside the cylinder to define two regions: a first region coupled to the first hydraulic conduit to receive an actuating fluid flow from the first conduit and a second region coupled to the second hydraulic conduit to receive an actuating fluid flow from the second hydraulic conduit.

The foregoing and other features and advantages of the invention will become further apparent from the following detailed description of the presently preferred embodiment, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
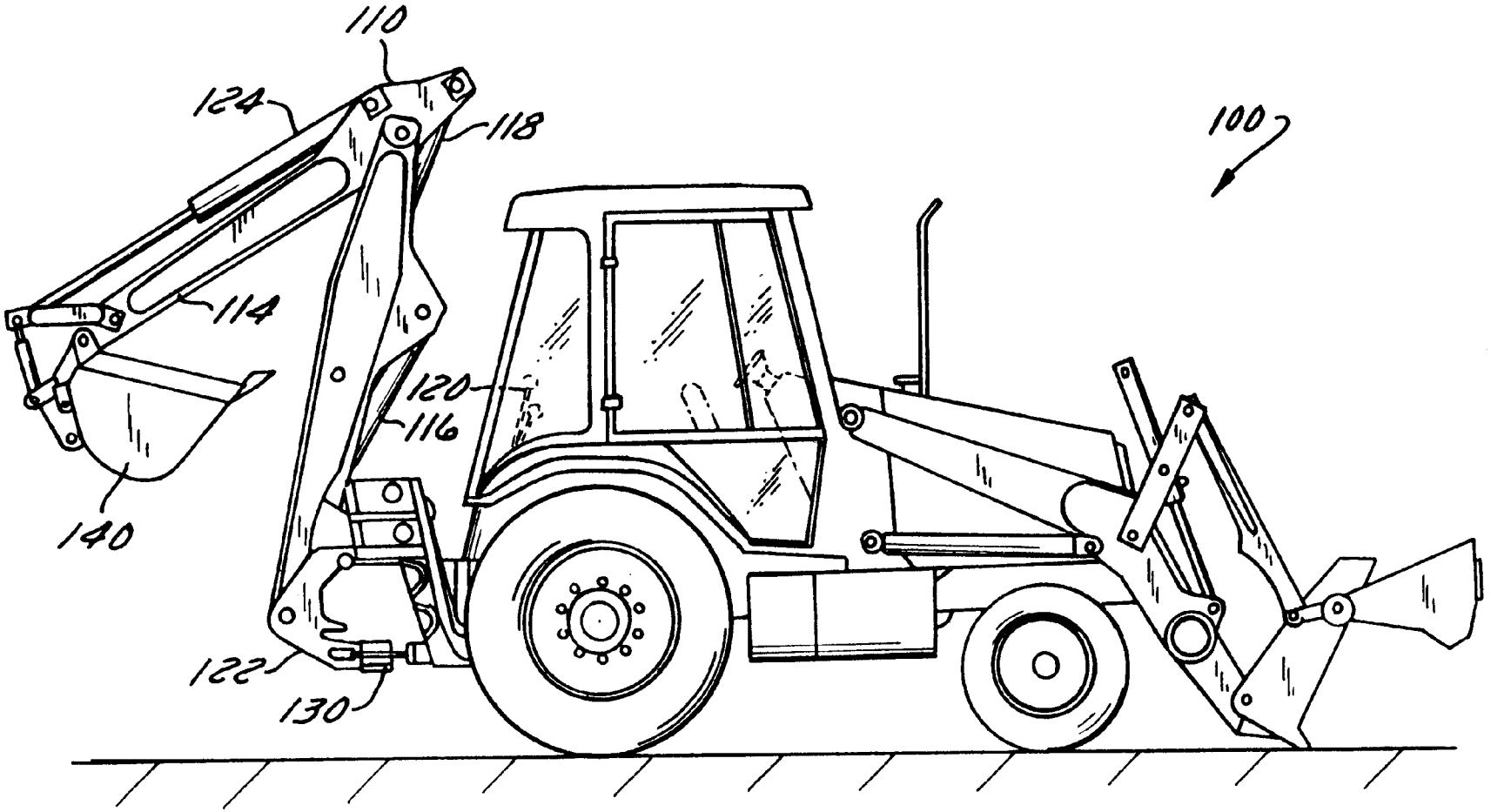
FIG. 1 is an illustration of a vehicle showing the backhoe linkage.

Referring to FIG. 1, one embodiment of a vehicle 100 equipped with a backhoe assembly 110 is shown.

Backhoe assembly 110 includes a boom 112, a dipper 114, a hydraulic boom lift cylinder 116, a hydraulic dipper cylinder 118, a boom base 122 (also known as a "boom base" or "swing tower"), a hydraulic bucket cylinder 124, and a bucket 140.

The swing tower 122 is pivotally mounted to backhoe linkage 130 to swing side-to-side with respect to vehicle 100 when boom swing cylinders 260 (FIG. 2) are extended and retracted. The boom 112 is pivotally coupled to swing tower 122 to raise and lower with respect to swing tower 122. The dipper 114 is pivotally coupled to boom 112 to raise and lower with respect thereto. The bucket is pivotally coupled to dipper 114 to open and close. Boom lift cylinder 116 raises and lowers the boom with respect to the boom base. Dipper cylinder 118 raises and lowers the dipper with respect to the boom. Bucket cylinder 124 opens and closes the bucket with respect to the dipper.

A heavy equipment operator typically controls the operation of a bucket 140, which is in communication with the backhoe assembly 110, by using a control assembly 120. The control assembly 120 is in communication with a backhoe linkage 130, which is in communication with the backhoe assembly 110. The operation of the control assembly 120 provides fluid flow direction allowing for the activation of at least one swing assembly actuator also known in the trade as a "boom swing cylinder", which is part of the backhoe linkage 130. The backhoe linkage 130 produces a side-to-side movement of the backhoe assembly 110. It is in the backhoe linkage 130 that a transfer of energy occurs when stopping a swinging backhoe assembly 110, which results in an unwanted oscillation.

An example of the energy transfer is detailed with reference to the embodiment of FIG. 1. When the backhoe linkage 130 is brought to a stop following a side-to-side maneuver, kinetic energy that is generated by the movement of the backhoe assembly 110, is transferred to hydraulic supply lines connected to the backhoe actuators of the backhoe linkage 130. The transferred energy produces a sharp increase (or spike) in fluid pressure. The increased fluid pressure transfers the energy as vector forces throughout the hydraulic system and the surrounding vehicle. The energy then returns in the opposite direction through the hydraulic lines and exerts vector forces back to the non-moving actuators. This transfer of energy continues back and forth until it is dispelled as heat, or is dissipated through the oscillation of the equipment and the swelling and contraction of the hydraulic lines.

Figure 2A:
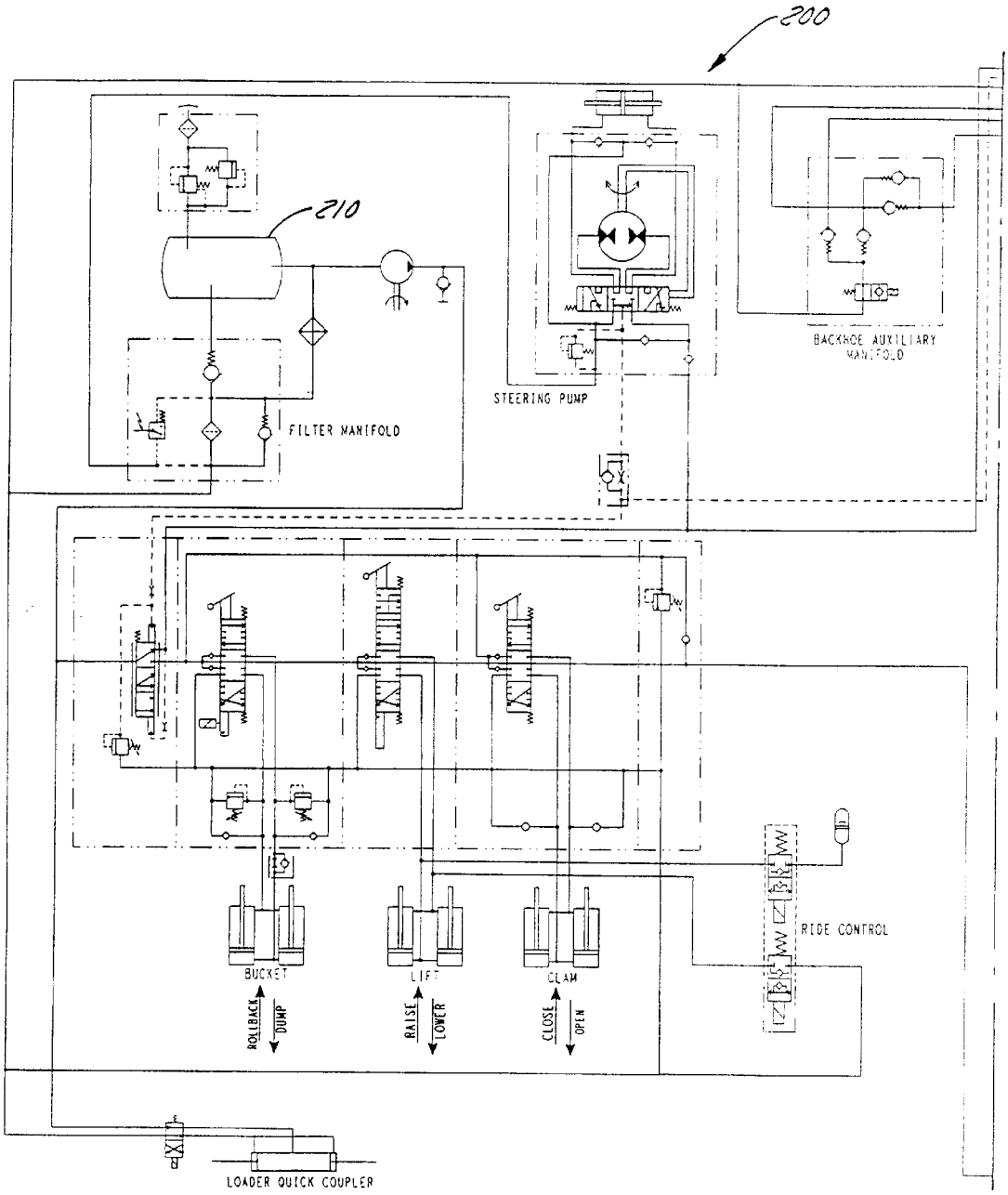
FIG. 2 is a schematic diagram of one embodiment detailing the hydraulic components of the backhoe linkage of FIG. 1.
Figure 2B:
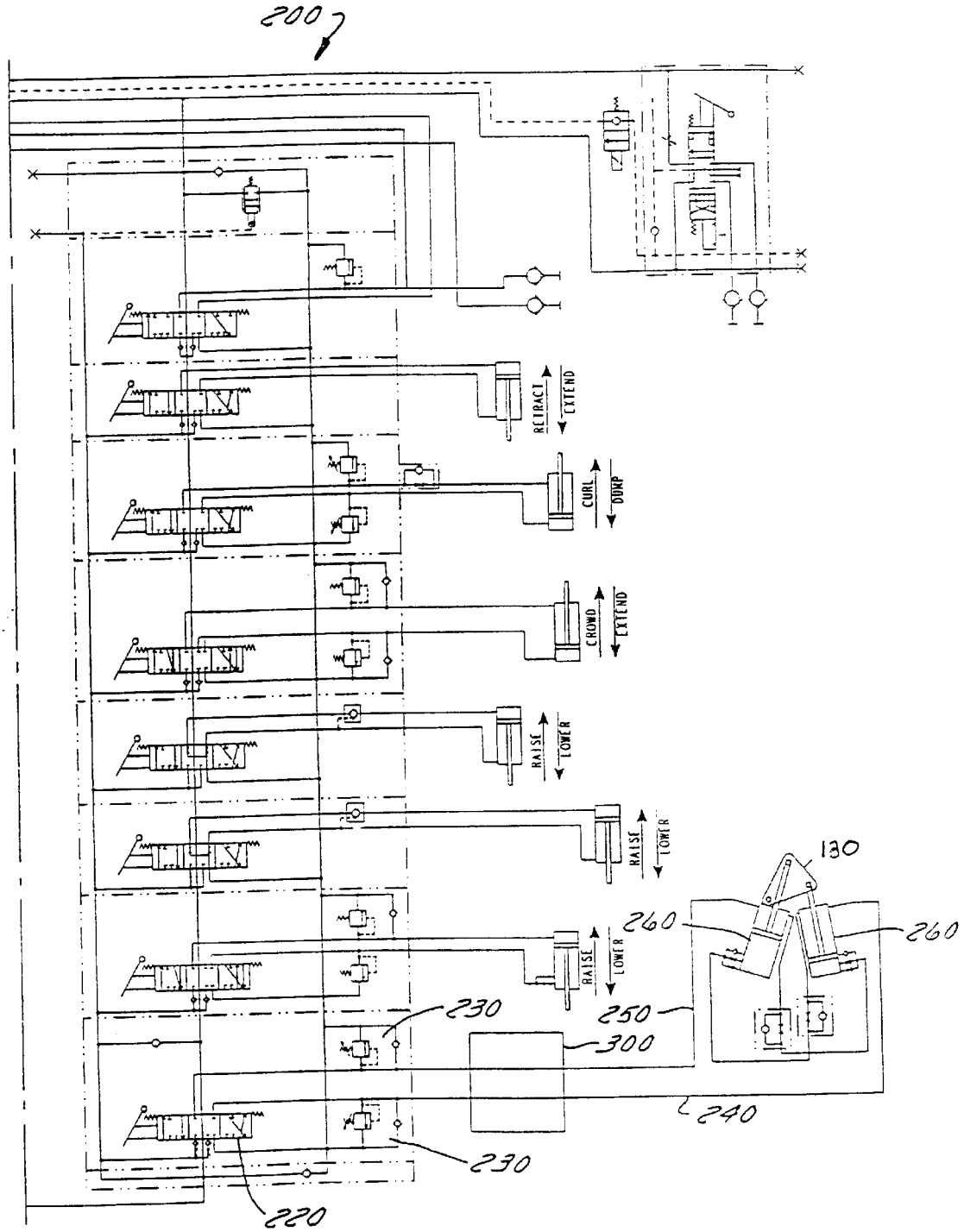

In FIG. 2, the hydraulic components of one embodiment of the invention are illustrated as a schematic 200 detailing a typical piece of heavy equipment utilizing the backhoe assembly 110 of FIG. 1. In this embodiment, a holding tank 210 supplies hydraulic fluid to a control valve 220 via a pump or the like. The hydraulic fluid flows to and from the swing cylinders 260 through the hydraulic lines 240 and 250, with the flow direction controlled by the operations of the control valve 220. The swing cylinders 260 are a component of the backhoe linkage 130, and the control valve 220 is a component of the control assembly 120 of FIG. 1. When the hydraulic line 240, or the hydraulic line 250 experiences an excessive buildup of pressure, a pressure sensitive relief valve 230 opens to allow the pressurized fluid to flow back to the holding tank 210. In this embodiment, the swing cushion device or swing damping circuit 300 is located in series with the hydraulic lines 240 and 250 between the control valve 220 and the swing cylinders 260 but may be positioned at different locations in alternative embodiments.

Figure 3:
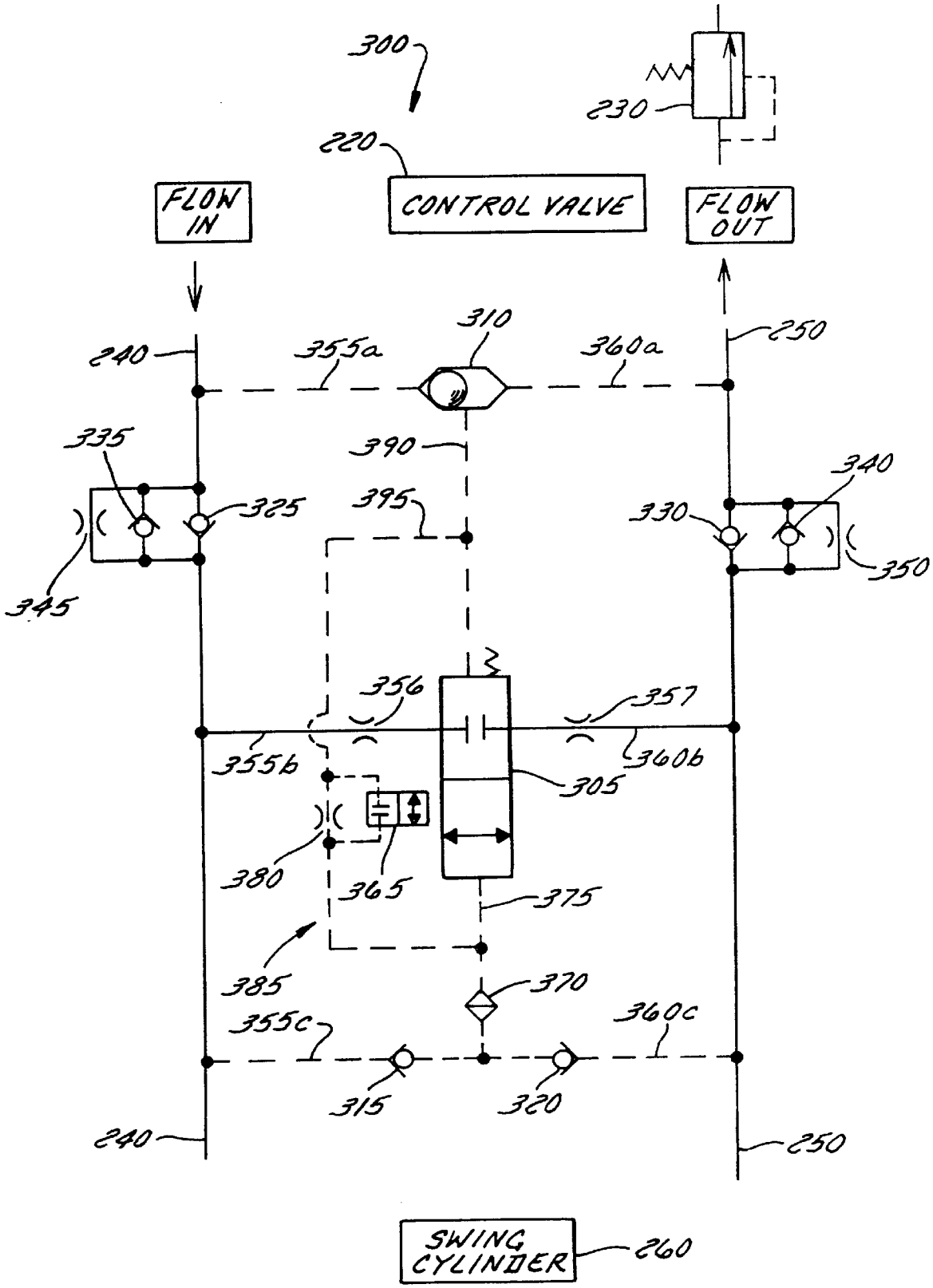
FIG. 3 is a schematic diagram of one embodiment of a hydraulic system, made in accordance with the invention.

One embodiment of the present invention is generally shown as a swing damping circuit 300 in FIG. 3. This embodiment is hydraulic in its operation but may be electrical or mechanical or a combination of thereof in alternative embodiments. The invention may be used as in this example, as part of the hydraulic components of a backhoe linkage, as demonstrated in FIG. 2. This embodiment entails the use of hydraulic lines 240 and 250 to supply and reclaim hydraulic fluid to the swing cylinders 260 while the control valve 220 directs the fluid flow. The hydraulic lines 240 and 250 may be of any variety used for the transfer of hydraulic fluid, with the hydraulic fluid being of any conventional type. The swing cylinders 260 are common in the trade and may vary in size, purpose, and number. A motion detector is used to control the flow of fluid to a crossover valve 305. The motion detector may comprise a variable potentiometer, or other electrical device that detects a measurable property such as resistance or voltage, or a pressure generator such as a check valve or orifice, and is in communication with either the control assembly 120 or the backhoe linkage 130. A motion detection system consisting of components 325, 335, 345, 340, 350, 330, 310, 315, 320 is shown as an illustrative example of one embodiment. An alternative embodiment of the motion detection system may sense fluid pressure, mechanical movement, or controller activation. The hydraulic line 240 is in series communication with check valves 335 and 325, and a bypass orifice 345. The hydraulic line 250 is in series communication with check valves 330 and 340, and a bypass orifice 350. The check valves 335, 325, 330, and 340 may allow flow in varying directions and activation pressures, and an alternative number or type of flow control systems known in the art may be used. The bypass orifices 345 and 350 may be conventional bypass orifices. Alternatively, other flow restricting mechanisms may be used or combined with the flow control check valves 335, 325, 330, and 340. Prior to and after the parallel check valves and bypass orifice, hydraulic lines 240 and 250 are in communication through hydraulic lines 355*a*, 355*c*, 360*a*, and 360*c* with flow control valves 310, 315, and 320. In FIG. 3 the flow control valves are depicted as a shuttle valve and a pair of check valves respectively, but may be comprised of alternative directional flow control variations. Flow control valve 310 is in communication with a spring side operational port of the crossover valve 305 through a hydraulic line 390. The crossover valve 305 may be a spool, poppet, solenoid, or other variable position electrohydraulic or hydraulic valve, and may alternatively be directed to open by motion, pressure, or electric means. A timing system for determining how long the crossover valve 305 allows flow between the hydraulic line 240 and the hydraulic line 250 can be used. The timing system may be electronic, electrohydraulic, or hydraulic as known in the art. A hydraulic timing system comprised of components 385, 325, 330, and 230 is shown as an illustrative example 300. The crossover valve 305 may use a spring tension system for operation but a valve using an alternative operating system know in the art may be used. The flow control valves 315 and 320 are in communication with a delay volume 375, which is a volume created by the opening of the crossover valve 305. During the closing of the crossover valve 305, the fluid in the delay volume flows through a restrictive system 385 via hydraulic line 395. The restrictive system 385 is comprised of the delay volume 375, a thermal actuated valve 365, and a delay orifice 380. Between the delay volume 375 and its connection with hydraulic lines 355*c*, 360*c*, and 395 is a fluid filter 370. The crossover valve 305 is further in communication with hydraulic lines 240 and 250 through hydraulic lines 355*b* and 360*b* respectively, and becomes a metered flow system between hydraulic lines 240 and 250 when the crossover valve 305 is activated. The metered system of hydraulic lines 355*b* and 360*b* are portrayed in FIG. 3 as crossover orifices 356 and 357 but alternative metering systems known in the trade may be used. Further, in communication with hydraulic lines 240 and 250 is at least one relief valve 230. The relief valve 230 uses a spring tension system for operation but a valve using an alternative operating system may be used.

An example of one embodiment of the invention as illustrated in FIG. 3 is detailed next. While the backhoe linkage 130 is not actuated (as when the control assembly 120 is in neutral), the bypass orifice 345 with a restrictive diameter of 0.030", acts as a bypass of the 100-psi check valve 325. The bypass allows fluid from the swing cylinders 260 side of the swing damping circuit 300 to replace any fluid seeping from the hydraulic line 240, through the control valve 220. This is done to keep the pressure difference between the flow control valve 310, and flow control valves 315 and 320, below the 40-psi pressure differential needed to overcome the spring preload of crossover valve 305.

When the control assembly 120 is operated to actuate the backhoe linkage 130, the pressure in the inertia of the supply line 240 is higher than the pressure in the reclaim line 250 because the backhoe assembly 110 resists the accelerating force from the swing cylinders 260. The higher pressure on the supply side acts to open the flow control valves 310 and 315 on the supply line 240 side. The open flow control valve 310 allows for the supply line 240 to act upon the hydraulic line 390. Hydraulic line 390 in turn acts upon the restrictor assembly 385 and crossover valve 305. The open flow control valve 315 allows for the supply line 240 to act upon the delay volume 375, which in turn acts upon the restrictor assembly 385 and crossover valve 305. Because the 5-psi check valve 335 restricts the fluid flowing in the supply line 240, the pressure on the restrictor assembly 385 and crossover valve 305 from the flow control valve 310 is higher than the pressure on the restrictor assembly 385 and crossover valve 305 from the delay volume 375. The resulting pressure differential is higher on the spring side of the crossover valve 305, which prevents the crossover valve 305 from shifting open.

When the control assembly 120 is operated to actuate the backhoe linkage 130 to decelerate the backhoe assembly 110, the pressure in the reclaim line 250 becomes higher than the pressure of the supply line 240 because of the load induced on the swing cylinders 260 by the kinetic energy of the backhoe assembly 110. The kinetic energy is transferred to fluid pressure in the reclaim line 250, and forces open the flow control valve 320 and closes control valve 315. The open flow valve 320 allows the reclaim line to act upon the restrictor assembly 385. This produces a higher pressure being exerted through the restrictor assembly on the non-spring side of the crossover valve 305. Sometimes the pressure differential between the non-spring side and the spring side of the crossover valve 305 remains below the 40 psi needed to activate the crossover valve 305. If the flow and pressures of fluid in the return line 250 is great enough, the 100-psi check valve 330, preset to restrict flow to the opposite direction of the check valve 340, opens and creates a pressure differential in the reclaim line 250. This condition shifts the flow control valve 310 to open to the reclaim line 250 side and results in a higher pressure being exerted through the restrictor assembly 385 on the non-spring side of the crossover valve 305, than on the spring side. If the pressure differential between the two ports of the crossover valve 305 surpasses the 40-psi spring tension, the crossover valve 305 will open. The open crossover valve 305 permits a flow of pressurized fluid between the supply line 240 and the reclaim line 250 through the hydraulic lines 355*b* and 360*b*. In hydraulic lines 355*b* and 360*b* are crossover orifices 356 and 357, restricting the fluid flowing through hydraulic lines 355*b* and 360*b*. This results in improved 'metering' of the pressure equalization between the supply and reclaim lines 240 and 250.

While stopping the motion of the backhoe assembly 110, just before to just after returning the control lever of the controlling assembly 120 to neutral, some flow may pass through the control valve 220 and exit through the relief valve 230. The release of fluid through the relief valve 230 aids in maintaining the pressure differential exerted on the crossover valve 305, which prevents it from closing. When the exiting fluid pressure becomes lower then the spring tension of the relief valve 230, the relief valve 230 closes and the flow of fluid through the 100-psi check valve 330 and orifice 350 stops. This causes the pressure exerted on the crossover valve 305 to equalize, resulting in the pressure differential to decrease below the 40-psi spring preload of the crossover valve 305, and the crossover valve 305 begins to shift closed.

When the crossover valve 305 begins to close, the restrictor assembly 385 controls the time required to complete the closing. It does this by slowing the flow of fluid between the non-spring side and spring side of the crossover valve 305, thus keeping the crossover valve 305 shifted for a short amount of time after the differentiating pressures have become negligible. At this time any pressure fluctuations within the supply line 240 and reclaim line 250, caused by the oscillating effect, are dampened by the fluid flow through the hydraulic lines 355*b* and 360*b*, and the crossover valve 305. This delayed closing assists in the reduction of the oscillatory motion when the swinging backhoe assembly 110 is brought to a stop.

In the illustrated embodiment, the restrictor assembly 385 of the swing damping circuit 300 incorporates a 0.018" diameter delay orifice 380, a thermal actuator 365 and a delay volume 375. The restrictor assembly 385 regulates the shifting of the crossover valve 305 to the closed position. The thermal actuator 380 regulates the orifice size as oil temperature varies. The thermal actuator 380 adjusts the amount of pressure drop through the restrictor assembly 385 as temperature varies above or below a prescribed temperature, shown in this embodiment as open below 50° F. and closed above 60° F. In alternative embodiments, a solenoid and a temperature sensitive switch, a bimetallic element, or wax element could also be used as the thermal actuator 365. An in line filter 370 can be used to prevent contamination from affecting the operation of the restrictor assembly 385.

Valve Operation

The operation of the swing damping circuit or device 300 (the "swing damping circuit"), as described above in conjunction with the circuit schematic shown in FIG. 3, is to damp the unwanted swinging of a backhoe assembly or other similar apparatus when the apparatus is being stopped by the operator. While the description above explains the functioning on a circuit level, it is beneficial to connect this explanation with a more common-sense understanding using a graphical representation of a series of valve operations. In the description below we will detail how the system shown in FIGS. 1–2 and in particular the swing damping circuit shown in FIGS. 2 and 3 function to control the movement of the backhoe assembly. To do this, we will describe how the operator must move the various components of the backhoe assembly to perform work.

First State: System at Rest

Assume the backhoe assembly is at rest and the operator has not yet operated the directional control valve 220 that swings the boom (also known as the "boom swing valve"). With no fluid entering the boom swing cylinders, both the velocity and the acceleration of the backhoe assembly is zero.

In this state of no movement, the pressure is essentially the same throughout the circuit of FIG. 3, and valve 305 is in the closed state.

Figure 4A:
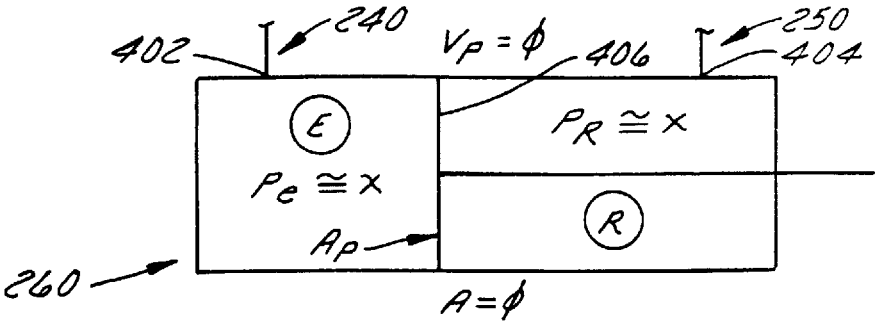
FIGS. 4A–4D are schematic diagrams of the boom swing cylinder of FIG. 2 in four different positions.

This state is shown in FIG. 4A. In FIG. 4A, one boom swing cylinder 260 of FIGS. 3 and 4 is shown. The two ports 402 and 404 of cylinder 260 are fluidly coupled to hydraulic lines 240 and 250, as also shown in FIGS. 2 and 3 and described in the accompanying text. The piston 406 in boom swing cylinder 260 defines two internal regions "E" and "R". When fluid from control valve 220 fills region E (through port 402) and escapes from region R (through port 404), the boom swing cylinder extends and swings the backhoe assembly in a first direction. When fluid fills port R and escapes from port E the boom swing cylinder retracts and swings the backhoe assembly in the opposite direction. In the rest state, the pressure in both the E and R regions is the same ($P_e$, $P_R \approx X$) and the piston has a velocity "V" of zero and an acceleration "A" of zero.

Second State: Initial Acceleration

To move the backhoe assembly from the rest state, the operator opens the boom swing valve. As a preliminary note, valve 220 is bi-directional as shown in FIG. 2. It can be opened either to send pressurized fluid into hydraulic line 240 and to return fluid from hydraulic line 250 to the tank, or to send pressurized fluid into hydraulic line 250 and to return fluid from hydraulic line 240 to the tank 210, depending upon the direction the operator moves the directional control valve. As shown in FIG. 3, the damping circuit is symmetrical and therefore operates the same regardless of the direction of hydraulic flow.

For simplicity, we will only discuss the operation of the system when the operator opens the valve to send pressurized fluid through hydraulic line 240 and into the cylinder in region E (and hence to return cylinder fluid from region R through hydraulic line 250 to the tank) causing piston 406 (FIG. 4) to move to the right. The operation of swing damping circuit 300 is identical in the reverse flow direction when pressurized fluid is sent through line 250 into the cylinder in region R causing piston 406 (and hence backhoe assembly 110) to move in the opposite direction.

Figure 4B:
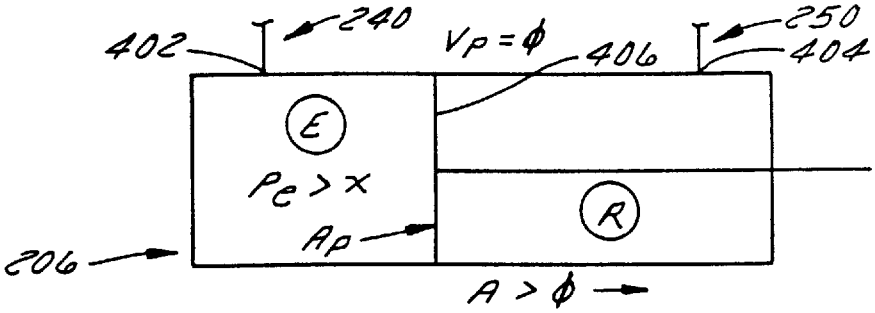

When the operator initially opens valve 220, fluid fills line 240, traveling from top to bottom (as shown in FIG. 3). The top end of line 240 is fluidly connected to the valve and the bottom end is fluidly coupled to the boom swing cylinder 260. As pressurized fluid is introduced into line 240 from valve 220, the fluid pressure in line 240 increases, and the pressure on the left-hand side of the boom swing cylinder piston increases (FIG. 4B).

Initially, fluid flow into and out of cylinder 260 is slow, since the backhoe assembly and hence the boom swing cylinder is at rest. There is a pressure differential on the piston of the boom swing cylinder, however, since pressurized fluid is applied by valve 220 to one side (region E). The other side of the piston (region R) is connected through line 250 and valve 220 to the hydraulic tank 210.

The boom swing cylinder begins to move with fluid entering the cylinder through line 240 and exiting the cylinder through line 250. The pressurized fluid provided through valve 220 causes the backhoe assembly to accelerate. As the backhoe assembly 110 begins moving faster and faster, pressurized fluid at a greater and greater rate enters the boom swing cylinder at port 402 from valve 220.

During this acceleration phase, both of check (or "flow control") valves 310 and 315 are shifted to the right (see FIG. 3), thereby applying the high valve supply pressure in line 240 to both ends of valve 305. This high-pressure fluid signal passes through check valve 315 in line 355*c* and flows through the signal line that passes upward through filter 370 and into volume 375 where it presses against the bottom of valve 305.

Valve 320 is closed blocking all flow to or from line 250 through signal line 360*c*, since the pressure in line 240 is greater than the pressure in line 250. Similarly, the higher pressure in line 240 passes a hydraulic fluid signal through signal line 355*a*, through check valve 310 and downward through signal line 390 where it presses against the top of valve 305. The ball of valve 310 is pressed against the right hand seat of valve 310 thus shutting off any flow either to or from line 250 through signal line 360*a*. With pressurized fluid flowing downward from the valve to the cylinders 260 through line 240, and upward through line 250, the net effect keeps the bypass passageway comprised of lines 355*b* and 360*b* and valve 305 closed.

The 5-psi check valve 335 causes only a 5-psi pressure difference across check valve 335, and hence 5-psi pressure applied to the upper end of valve 305. This net 5-psi pressure difference, in addition to the 40-psi pressure of the spring that is applied to the upper end (in FIG. 3) of valve 305 keeps valve 305 in a closed position.

The initial acceleration is shown in FIG. 4B. In this FIGURE, the operator has opened control valve 220 and has thereby applied fluid from the hydraulic pump through valve 220, through hydraulic line 240 to port 402 and hence to region E. This pressurizes the fluid in region E to a pressure $P_e$ that is greater than some pressure "x".

Figure 4C:
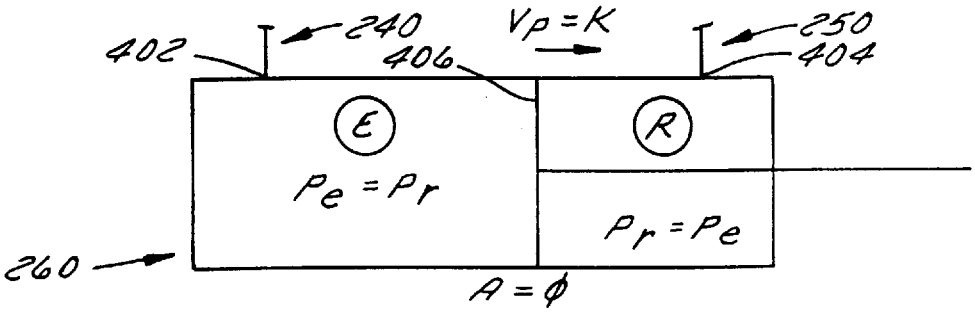

At the same time, the opening of control valve 220 has connected port 404 and hence line 250 and region R to the hydraulic tank, which has a pressure of approximately zero psi. Since the pressure $P_e$ in region E is greater than the pressure $P_r$ in region R, the piston has begun to accelerate (A>Ø) and will move to the right (as shown in FIG. 4C). As the backhoe assembly accelerates due to the higher force applied in region E, its kinetic energy and momentum will increase. The velocity of the piston 406 and hence the velocity of the backhoe assembly will increase in a rightward direction (in FIG. 4B) for as long as control valve 220 applies a greater force to the left side of the piston than to the right side of the piston.

Third State: Transition from Acceleration to Deceleration

At some point, the operator has the backhoe assembly swinging at the desired velocity and he therefore eases off on boom swing control valve 220. By "ease off" we mean that the operator begins to close the valve until the rate of fluid flow passing through valve 220 and entering cylinder 260 just matches the rate at which the now-moving backhoe assembly moves piston in the boom swing cylinder. At this transition point the fluid leaving the cylinder is at substantially the same pressure as the fluid entering the cylinder: about 100 psi in this embodiment, with tank 210 at Ø psi and a 100 psi check valve in line 250.

As long as the operator holds control valve 220 open enough to just make up for the backhoe momentum-induced movement of the piston in the boom swing cylinder, the backhoe assembly will keep swinging, slowing down only as a result of friction between the moving components.

During this transition from acceleration to deceleration, the pressures on both sides of the boom swing cylinder piston 406 are substantially the same and the forces on both sides are also generally the same.

Depending upon the speed the backhoe is swinging, there will be a 5-psi pressure drop across check valve 335 and a 100-psi pressure drop across check valve 330. Thus, the pressure at the upper end of line 240 supplied by valve 220 will be about 105 psi, the pressure at the bottom end of line 240 will be about 100 psi, the pressure at the bottom end of line 250 will be about 100 psi, and the pressure at the upper end of line 250 will be about zero psi. Again, this assumes a tank pressure of about zero psi and no flow losses in hydraulic lines 240 and 250.

At this transition point, the ball of check valve 310 is shifted to the right, and the 105-psi pressure signal will be applied to the upper end (the spring-loaded end) of valve 305.

The lower ends of lines 240 and 250 will be at the same pressure. By definition of the transition state the same pressure is applied to both ports of the boom swing cylinders, to which the lower ends of lines 240 and 250 are attached. Check valves 315 and 320 will be in an unknown state, but regardless of their state, a pressure of about 100 psi will be applied to the bottom of valve 305 through those check valves, since both check valves 315 and 320 have about the same pressure of 100 psi applied thereto.

Thus, at the transition point, there will be a 105 (fluid pressure)+40 psi (spring pressure)=145 psi force acting on the top of valve 305 and 100 psi acting on the bottom of valve 305. Valve 305 will therefore remain closed just as it was with the system at rest (FIG. 4A) and under acceleration (FIG. 4B).

This is shown in FIG. 4C. In FIG. 4C, the piston has a constant piston velocity $V_P$ of K in the rightward direction, causing region E to increase in volume and region R to decrease in volume at generally the same rate.

The regions change in volume not due to work performed on the piston 406 by pressurized fluid flowing into cylinder 260 from valve 220, since the pressure on either side of piston 406 is about 100 psi. With a differential pressure of zero psi across piston 406, the piston moves due to the momentum—the kinetic energy—of the backhoe assembly, and not due to work done on the piston by the hydraulic fluid flowing through control valve 220.

Fourth State: Active Deceleration of the Backhoe Assembly

The transition state will typically be a fleeting state momentarily reached as the operator moves the valve from accelerating the backhoe assembly 110 to decelerating (i.e. slowing and stopping) the backhoe assembly.

The deceleration state is the state in which the operator actively decelerates the backhoe assembly. The backhoe assembly decelerates whenever control valve 220 is closed to the point that the pressure difference across the piston of the boom swing cylinder acts to slow the backhoe assembly down.

Figure 4D:
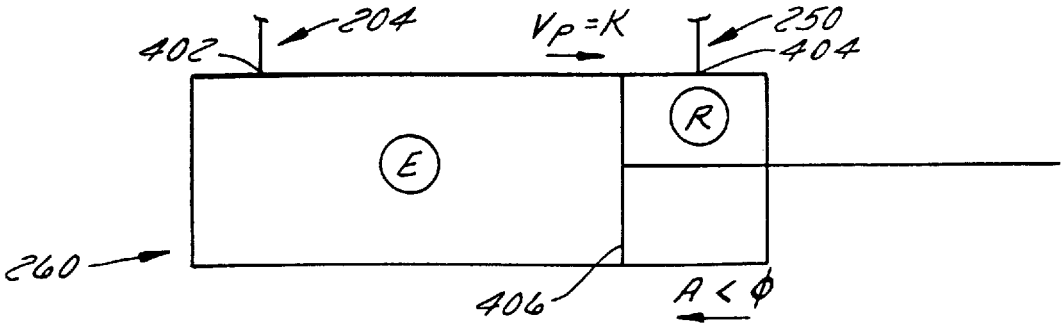

To enter the deceleration state, the operator further closes control valve 220 such that the pressure in region R is slightly greater than it was in the transition state, and the pressure in region E is less than it was in the transition state, as shown in FIG. 4D. For example, when control valve 220 is closed slightly from the transition state, valve 220 no longer provides fluid to region E at a rate fast enough to keep up with the rightward inertial motion of the piston and backhoe assembly. Similarly, the operators further closing of valve 220 no longer permits enough fluid to exit region R to keep up with the rightward motion of the piston. The piston, due to the inertia of backhoe assembly 110, tends to continue moving at velocity $V_P$=K to the right.

As a result of this, the kinetic energy of the backhoe assembly moving piston 406 at velocity $V_P$=K causes pressure to increase in region R as the piston presses against the fluid in region R, which is not escaping fast enough. At the same time, pressure drops in region E as valve 220 permits less fluid to enter region E. The result of these pressure changes is the creation of a pressure differential across the piston, wherein a higher pressure exists in region R than in region E. This pressure differential is generated not by the pressurized fluid source, but by the momentum—the kinetic energy—of the backhoe assembly acting against the piston, which in turn forces fluid out of region R. As a result, the piston begins to decelerate. By "decelerate" it is meant that the absolute value of the piston velocity is reduced.

As a result of the closing of control past the transition point such that the backhoe assembly begins to decelerate, pressure builds up in line 250 and drops in line 240. If control valve 220 is not closed all the way, fluid will still flow downward (in FIG. 3) through line 240 into region E and out of region R upward (in FIG. 3) through line 250 and back to the tank just as it did during the acceleration phase. There is one significant difference, however. Although the fluid is flowing into and out of boom swing cylinder 260 in the same directions, the pressure levels in lines 240 and 250 are reversed. Line 250 (FIG. 3) is now pressurized by the momentum of backhoe assembly 110 acting on cylinder 260 to pressurize region R, and line 240 (FIG. 3) is substantially depressurized because valve 220 is cutting off fluid flow into region E.

We will return now to FIG. 3 to explain how the deceleration state with the increased pressure in line 250 and the decreased pressure in line 240 changes the operation of the swing damping circuit.

In the explanation of the transition state, above, we explained that the constant velocity state is achieved when the pressure in both region E and region R is about 100 psi with the assumption of no loss of pressure in the hydraulic lines and with a tank pressure of about zero psi.

As control valve 220 closes, pressure will drop in line 240 below the 105/100-psi pressures we described above for the transition state. As valve 220 closes, fluid leaving the upper end of line 250 (and therefore region R) will be restricted. Pressure will increase above the transitional pressure (FIG. 4C) of 100 psi in the lower end of line 250.

As the pressure in the lower end of line 240 drops below the rising pressure in the lower end of line 250, check valve 315 will close and check valve 320 will open, conducting a hydraulic fluid signal at the lower end of line 250 through signal line 360*c*, upward through the vertical signal line passing through filter 370, thence into chamber (or "delay volume") 375 and against the lower end of valve 305. Flow through signal line 355*c* is prevented because the pressure in line 250 is greater than the pressure in line 240 and closes valve 315.

The increasing pressure in the upper end of line 250 and the dropping pressure in the upper end of line 240 similarly shifts the ball of valve 310 leftward, connecting the upper end of line 250 to the upper end of valve 305 through signal line 360*a*, check valve 310, and signal line 390. Flow through hydraulic signal line 355*a* is blocked, due to the greater pressure in line 250 than in line 240. This pressure forces the ball of valve 310 against the left seat thereby preventing all flow through signal line 355*a*.

The moving backhoe assembly generates a pressure drop greater than 40 psi across check valve 330 and orifice 350 as valve 220 is closed and the backhoe assembly begins to decelerate. Thus, the fluid pressure acting on the lower end of valve 305 is greater than the pressure acting on the upper end of valve 305. Valve 305 therefore opens, permitting fluid to pass through hydraulic lines 360*b* and 355*b* and therefore from region R to region E (FIG. 4) of the boom swing cylinders.

Fifth State: Stopping of the Backhoe Assembly

As described above, valve 305 is opened by the conversion of the kinetic energy of the backhoe assembly into a valve opening force. This force is applied to opposing ends of valve 305 through hydraulic signal lines 360*a* and 360*c*. A 100 psi difference in pressure between the upper portion of line 250 and the lower portion of line 250 caused by check valve 330 and orifice 350 results in a 100 psi difference in pressure applied by the hydraulic fluid signals in lines 360*a*–360*c* acting on the ends of valve 305. This pressure difference is sufficient to overcome the 40-psi preload pressure of the spring that presses against the upper end (in FIG. 3) of valve 305 and that would otherwise hold the valve closed.

Once valve 305 is moved by the filling of delay volume 375 with fluid, it cannot close until the fluid in this volume escapes. The fluid in the volume cannot escape to either line 240 or 250 because valves 315 and 320 both close, however. The only escape path for the fluid is through the fluid passageways of what is called the "restrictor assembly" or "restrictive system", above. This circuit includes a delay orifice 380 that restricts the flow rate of the escaping fluid and thereby slows down the closing rate of valve 305, hence it is called a "delay orifice," above.

As the backhoe assembly's kinetic energy is dissipated by the force from the pressure in region R of cylinder 260 and the backhoe assembly slows down, the pressure in line 250 drops. The pressure in line 250 and the pressure drop across check valve 330 and orifice 350 begin to decrease. However, even when the pressure difference across check valve 330 and orifice 350 (and hence the pressure difference across valve 305) has dropped below the approximately 40 psi required to hold valve 305 open, valve 305 will remain open until fluid in volume 375 has leaked out through the restrictor assembly 385.

CONCLUSION

In sum, the bypass or crossover valve 305 only opens when control valve 220 is closed sufficiently to decelerate the backhoe assembly 110 by blocking free fluid flow out of the cylinder 260. This restriction in flow at valve 220 causes the kinetic energy (inertia or momentum) of the backhoe assembly to raise the pressure in region R and to force fluid out of the cylinder. The fluid forced out of the cylinder 260 and upward (FIG. 3) through line 250 is directed against opposing ends of valve 305, thereby opening it. The kinetic energy and momentum of the backhoe assembly open valve 305.

While the operator accelerates the backhoe assembly, however, valve 305 remains closed, since flow downward through lines 240 or 250 cannot develop a pressure differential sufficient to open valve 305 when pressure in hydraulic lines 240 is greater than the pressure in hydraulic line 250. The circuit is therefore responsive to the deceleration of the boom swing cylinder and the backhoe assembly, and provides a fluid flow path from a high-pressure region of the boom swing cylinder (where the high pressure is generated by the kinetic energy or momentum of the backhoe assembly) to a lower pressure region. The valve 305 is opened by the kinetic energy or momentum in response to a difference in pressure in line 250: a hydraulic line that is disposed to conduct fluid exiting the boom swing cylinder back to the hydraulic tank.

While specific embodiments of the present invention have been shown and described, it will be apparent to those skilled in the art that the disclosed invention may be modified in numerous ways and may assume many embodiments other than those specifically set out and described above. Accordingly, the scope of the invention is indicated in the appended claims, and all changes that come within the meaning and range of equivalents are intended to be embraced therein.

What is claimed is:

1. A hydraulic system for suppressing oscillation in a linkage of heavy equipment comprising:

first and second hydraulic conduits;

a crossover valve in communication with the first and second hydraulic conduits to control the flow of hydraulic fluid between the first and second conduits; and a hydraulic control circuit in communication with the valve and configured to open the valve in response to and at least during the deceleration of the linkage of heavy equipment.

2. The system of claim 1 further comprising at least one dual-ported hydraulic cylinder coupled to the linkage to move the linkage and further wherein the hydraulic control circuit is responsive to a flow of fluid ejected from the cylinder by conversion of kinetic energy of the linkage.

3. The system of claim 2, wherein the valve is configured to open in response to the flow of fluid ejected from the cylinder by conversion of kinetic energy of the linkage.

4. The system of claim 3, wherein the valve, once opened, is configured to remain open for a predetermined period of time after stoppage of the flow of fluid ejected from the cylinder by conversion of kinetic energy of the linkage.

5. A hydraulic system for suppressing oscillation in a linkage of heavy equipment comprising:

first and second hydraulic conduits;

a crossover valve in communication with the first and second hydraulic conduits to control the flow of hydraulic fluid between the first and second conduits;

a hydraulic control circuit in communication with the valve and configured to open the valve in response to the deceleration of the linkage of heavy equipment; and at least one dual-ported hydraulic cylinder coupled to the linkage to move the linkage and further wherein the hydraulic control circuit is responsive to a flow of fluid ejected from the cylinder by conversion of kinetic energy of the linkage, wherein the valve is configured to open in response to the flow of fluid ejected from the cylinder by conversion of kinetic energy of the linkage, wherein the valve, once opened, is configured to remain open for a predetermined period of time after stoppage of the flow of fluid ejected from the cylinder by conversion of kinetic energy of the linkage, and wherein the hydraulic control circuit includes a first hydraulic signal line coupled to the valve to apply a closing force to the valve and a second hydraulic signal line coupled to the valve to apply an opening force to the valve.

6. The system of claim 5, wherein fluid pressure applied to the first signal line tends to close the valve and fluid pressure applied to the second hydraulic signal line tends to open the valve.

7. The system of claim 6, wherein the first hydraulic signal line is fluidly coupled to the first conduit when the fluid pressure in the first conduit is greater than the fluid pressure in the second conduit and is also fluidly coupled to the second conduit when the fluid pressure in the second conduit is greater than the fluid pressure in the first conduit.

8. The system of claim 7, wherein the second hydraulic signal line is fluidly coupled to the first conduit when the fluid pressure in first conduit is greater than the fluid pressure in the second conduit and is also fluidly coupled to the second conduit when the fluid pressure in second conduit is greater than the fluid pressure in the first conduit.

9. The system of claim 8, wherein the first hydraulic signal line is configured to prevent hydraulic fluid that has entered the first hydraulic signal line from returning to the first and second conduits.

10. The system of claim 9, wherein the first hydraulic signal line includes at least one check valve configured to prevent fluid in the first hydraulic signal line from returning to the first and second conduits.

11. The system of claim 7 wherein the first hydraulic signal line always fluidly couples one of the first and second conduits, but not both, to the crossover valve.

12. A hydraulic system for suppressing oscillation in a linkage of heavy equipment comprising:

first and second hydraulic conduits;

a crossover valve in communication with the first and second hydraulic conduits to control the flow of hydraulic fluid between the first and second conduits; and a hydraulic control circuit in communication with the valve and configured to open the valve in response to the deceleration of the linkage of heavy equipment, wherein the valve is configured (1) to open in response to a flow of fluid in the first conduit that is ejected from a hydraulic cylinder by conversion of kinetic energy of the linkage, and (2) to open in response to a flow of fluid in the second conduit that is ejected from the cylinder by conversion of kinetic energy of the linkage.

13. The system of claim 1 further comprising a first flow restriction device fluidly coupled to the first conduit between a first and a second portion of the first conduit to provide a first pressure drop in response to fluid flow in a first direction through the first conduit.

14. A hydraulic system for suppressing oscillation in a linkage of heavy equipment comprising:

first and second hydraulic conduits;

a crossover valve in communication with the first and second hydraulic conduits to control the flow of hydraulic fluid between the first and second conduits;

a hydraulic control circuit in communication with the valve and configured to open the valve in response to the deceleration of the linkage of heavy equipment; and a first flow restriction device fluidly coupled to the first conduit between a first and a second portion of the first conduit to provide a first pressure drop in response to fluid flow in a first direction through the first conduit, wherein the hydraulic control circuit includes a first hydraulic signal line fluidly coupled to and between the valve and the first portion of the first conduit and configured to apply a closing force to the valve, and a second hydraulic signal line fluidly coupled to and between the valve and the second portion of the first conduit and configured to apply an opening force to the valve.

15. The system of claim 14 wherein fluid pressure applied to the first signal line tends to close the valve and fluid pressure applied to the second hydraulic signal line tends to open the valve.

16. A hydraulic system for suppressing oscillation in a linkage of heavy equipment comprising:

first and second hydraulic conduits;

a crossover valve in communication with the first and second hydraulic conduits to control the flow of hydraulic fluid between the first and second conduits;

a hydraulic control circuit in communication with the valve and configured to open the valve in response to the deceleration of the linkage of heavy equipment;

a first flow restriction device fluidly coupled to the first conduit between a first and a second portion of the first conduit to provide a first pressure drop in response to fluid flow in a first direction through the first conduit, and a second flow restriction device fluidly coupled to the second conduit between a first and a second portion of the second conduit to provide a second pressure drop in response to fluid flow in a first direction through the second conduit.

17. A hydraulic system for suppressing oscillation in a linkage of heavy equipment comprising:

first and second hydraulic conduits;

a crossover valve in communication with the first and second hydraulic conduits to control the flow of hydraulic fluid between the first and second conduits;

a hydraulic control circuit in communication with the valve and configured to open the valve in response to the deceleration of the linkage of heavy equipment; and a first flow restriction device fluidly coupled to the first conduit between a first and a second portion of the first conduit to provide a first pressure drop in response to fluid flow in a d first direction through the first conduit, and a third flow restriction device fluidly coupled to the first conduit between the first and the second portion of the first conduit to provide a second pressure drop in response to fluid flow through the first conduit in a second direction opposite the first direction.

18. The system of claim 17, wherein the first pressure drop and the second pressure drop are different.

19. The system of claim 18, wherein the first pressure drop is less than that of the second pressure drop.

20. The system of claim 18, wherein the valve is configured (1) not to open when a pressure difference equal to the first pressure drop is applied across the valve; and (2) to open when a pressure difference equal to the second pressure drop is applied across the valve.

21. The system of claim 17 further comprising a fourth flow restriction device fluidly coupled to the second conduit between the first and second portions of the second conduit to provide a third pressure drop in response to fluid flow through the second conduit in a third direction.

22. The system of claim 21 wherein the first pressure drop and the third pressure drop are the same.

23. The system of claim 21 wherein the first pressure drop and the second pressure drop are different.

24. A backhoe comprising:

(a) a vehicle;

(b) a hydraulic fluid pump;

(c) a hydraulic fluid tank fluidly coupled to and providing hydraulic fluid to the pump;

(d) a backhoe assembly coupled to the vehicle to swing with respect to the vehicle;

(e) at least one bi-directional dual-ported boom swing cylinder coupled to the backhoe assembly and the vehicle to swing the assembly;

(f) a bi-directional hydraulic control valve fluidly coupled to the pump and tank and to the at least one cylinder to regulate the flow rate and direction of the flow of actuating fluid to the at least one cylinder;

(g) first and second hydraulic conduits coupled to and between the control valve and the at least one cylinder, wherein the first and second hydraulic conduits are disposed to conduct the flow of hydraulic fluid to the at least one cylinder from the control valve and to the control valve from the at least one cylinder; and (h) a swing damping circuit coupled to the first and second conduits for suppressing oscillation of the backhoe assembly, the circuit comprising:

(i) a crossover valve in fluid communication with the first and second conduits to control the flow of hydraulic fluid between the first and second conduits; and (ii) a hydraulic control circuit in communication with the crossover valve and configured to open the crossover valve in response to and at least during deceleration of the backhoe assembly with respect to the vehicle.

25. The backhoe of claim 24, wherein the hydraulic control circuit is responsive to a flow of fluid ejected from the cylinder by conversion of kinetic energy of the backhoe assembly.

26. The backhoe of claim 25, wherein the crossover valve is configured to open in response to the flow of fluid ejected from the cylinder by conversion of kinetic energy of the backhoe assembly.

27. A backhoe comprising:

(a) a vehicle;

(b) a hydraulic fluid pump;

(c) a hydraulic fluid tank fluidly coupled to and providing hydraulic fluid to the pump;

(d) a backhoe assembly coupled to the vehicle to swing with respect to the vehicle;

(e) at least one bi-directional dual-ported boom swing cylinder coupled to the backhoe assembly and the vehicle to swing the assembly;

(d) a bi-directional hydraulic control valve fluidly coupled to the pump and tank and to the at least one cylinder to regulate the flow rate and direction of the flow of actuating fluid to the at least one cylinder;

(e) first and second hydraulic conduits coupled to and between the control valve and the at least one cylinder, wherein the first and second hydraulic conduits are disposed to conduct the flow of hydraulic fluid to the at least one cylinder from the control valve and to the control valve from the at least one cylinder; and (f) a swing damping circuit coupled to the first and second conduits for suppressing oscillation of the backhoe assembly, the circuit comprising:

(g) a crossover valve in fluid communication with the first and second conduits to control the flow of hydraulic fluid between the first and second conduits; and (h) a swing damping circuit coupled to the first and second conduits for suppressing oscillation of the backhoe assembly, the circuit comprising:

(i) a crossover valve in fluid communication with the first and second conduits to control the flow of hydraulic fluid between the first and second conduits; and (ii) a hydraulic control circuit in communication with the crossover valve and configured to open the crossover valve in response to deceleration of the backhoe assembly with respect to the vehicle, wherein the hydraulic control circuit is responsive to a flow of fluid ejected from the cylinder by conversion of kinetic energy of the backhoe assembly, wherein the crossover valve is configured to open in response to the flow of fluid ejected from the cylinder by conversion of kinetic energy of the backhoe assembly, and wherein the hydraulic control circuit includes a first hydraulic signal line coupled to the crossover valve to apply a closing force to the crossover valve, and a second hydraulic signal line coupled to the crossover valve to apply an opening force to the crossover valve.

28. The backhoe of claim 27, wherein fluid pressure applied to the first hydraulic signal line tends to close the crossover valve and fluid pressure applied to the second hydraulic signal line tends to open the crossover valve.

29. The backhoe of claim 28, wherein the first hydraulic signal line is fluidly coupled to the first conduit when the fluid pressure in the first conduit is greater than the fluid pressure in the second conduit, and wherein the first hydraulic signal line is also fluidly coupled to the second conduit when the fluid pressure in the second conduit is greater than the fluid pressure in the first conduit.

30. The backhoe of claim 29, wherein the second hydraulic signal line is fluidly coupled to the first conduit when the fluid pressure in the first conduit is greater than the fluid pressure in the second conduit and wherein the second hydraulic signal line is also fluidly coupled to the second conduit when the fluid pressure in the second conduit is greater than the fluid pressure in the first conduit.

31. The backhoe of claim 30, wherein the first hydraulic signal line is configured to prevent hydraulic fluid that has entered the first hydraulic signal line from returning to the first and second conduits.

32. The backhoe of claim 31, wherein the first hydraulic signal line includes at least one check valve configured to prevent fluid from the first hydraulic signal line from returning to the first and second conduits.

33. A backhoe comprising:

(a) a vehicle;

(b) a hydraulic fluid pump;

(c) a hydraulic fluid tank fluidly coupled to and providing hydraulic fluid to the pump;

(d) a backhoe assembly coupled to the vehicle to swing with respect to the vehicle;

(e) at least one bi-directional dual-ported boom swing cylinder coupled to the backhoe assembly and the vehicle to swing the assembly;

(f) a bi-directional hydraulic control valve fluidly coupled to the pump and tank and to the at least one cylinder to regulate the flow rate and direction of the flow of actuating fluid to the at least one cylinder;

(g) first and second hydraulic conduits coupled to and between the control valve and the at least one cylinder, wherein the first and second hydraulic conduits are disposed to conduct the flow of hydraulic fluid to the at least one cylinder from the control valve and to the control valve from the at least one cylinder; and (h) a swing damping circuit coupled to the first and second conduits for suppressing oscillation of the backhoe assembly, the circuit comprising:

(i) a crossover valve in fluid communication with the first and second conduits to control the flow of hydraulic fluid between the first and second conduits; and (ii) a hydraulic control circuit in communication with the crossover valve and configured to open the crossover valve in response to deceleration of the backhoe assembly with respect to the vehicle wherein the crossover valve is configured (1) to open in response to a flow of fluid in the first conduit that is ejected from the cylinder by conversion of kinetic energy of the backhoe assembly, and (2) to open in response to a flow of fluid in the second conduit that is ejected from the cylinder by conversion of kinetic energy of the backhoe assembly.

34. The backhoe of claim 33, wherein the hydraulic control circuit is configured to apply the fluid ejected from the cylinder to the crossover valve to open the crossover valve to a position in which fluid can flow between the first and second conduits.

35. The backhoe of claim 33, wherein the control valve is configured to cause the deceleration of the backhoe assembly.

36. The backhoe of claim 35, wherein the cylinder includes an internal piston that is movable inside the cylinder to define two regions: a first region coupled to the first hydraulic conduit to receive an actuating fluid flow from the first conduit and a second region coupled to the second hydraulic conduit to receive an actuating fluid flow from the second hydraulic conduit.

37. A hydraulic system for suppressing oscillation in a linkage of heavy equipment comprising:

first and second hydraulic conduits;

a crossover valve in communication with the first and second hydraulic conduits to control the flow of hydraulic fluid between the first and second conduits;

a hydraulic control circuit in communication with the valve and configured to open the valve in response to the deceleration of the linkage of heavy equipment, the hydraulic control circuit including at least first and second hydraulic signal lines, the first signal line being coupled to and between the crossover valve and the first conduit and the second signal line being coupled to and between the crossover valve and the second conduit.

38. A hydraulic system for suppressing oscillation in a linkage of heavy equipment comprising:

first and second hydraulic conduits;

a crossover valve in communication with the first and second hydraulic conduits to control the flow of hydraulic fluid between the first and second conduits; and a hydraulic control circuit in communication with the valve and configured to open the valve in response to hydraulic fluid flow from a hydraulic cylinder through a pressure relief valve during deceleration.

39. A hydraulic system for suppressing oscillation in a linkage of heavy equipment comprising:

first and second hydraulic conduits;

a crossover valve in communication with the first and second hydraulic conduits to control the flow of hydraulic fluid from the first conduit to the second conduit and from the second conduit to the first conduit; and a hydraulic control circuit in communication with the valve and with both the first and second conduits, said control circuit being configured to open the valve in response to the deceleration of the linkage of heavy equipment.

40. A hydraulic system for suppressing oscillation in a linkage of heavy equipment comprising:

first and second hydraulic conduits;

a crossover valve in communication with the first and second hydraulic conduits to control the flow of hydraulic fluid between the first and second conduits; and a hydraulic control circuit in communication with the valve and configured to open the valve in response to the deceleration of the linkage of heavy equipment and to maintain the valve closed during subsequent acceleration.

41. A hydraulic system for suppressing oscillation in a linkage of heavy equipment comprising:

a hydraulic motor operably coupled to the linkage;

a directional control valve configured to control the motion of the hydraulic motor;

first and second hydraulic conduits coupled to and extending between the hydraulic motor and the directional control valve;

a crossover valve in communication with the first and second hydraulic conduits to control the flow of hydraulic fluid between the first and second conduits; and a hydraulic control circuit in communication with the valve and configured to open the valve in response to the deceleration of the linkage of heavy equipment and capable of opening the crossover valve at least when the directional control valve is in a closed position.

* * * * *